US005987703A

United States Patent [19]

Klüting et al.

[11] Patent Number: 5,987,703

[45] Date of Patent: Nov. 23, 1999

[54] DETACHABLE DOOR HINGE FOR A MOTOR VEHICLE DOOR

[75] Inventors: Bernd-Alfred Klüting, Radevormwald; Klaus Menten, Remscheid; Heinrich Osterkamp, Wermelskirchen, all of Germany

[73] Assignee: ED. Scharwächter GmbH, Remscheid, Germany

[21] Appl. No.: 09/094,304

[22] Filed: Jun. 9, 1998

[30] Foreign Application Priority Data

Jun. 9, 1997 [DE] Germany ..... 197 24 202

[51] Int. Cl.[6] ..... E05D 7/10; E05D 5/12

[52] U.S. Cl. ..... 16/262; 16/263; 16/380; 16/386

[58] Field of Search ..... 16/261, 262, 263, 16/264, 254, 273, 380, 381, 386

[56] References Cited

U.S. PATENT DOCUMENTS

| | | | |
|---|---|---|---|
| 1,847,937 | 3/1932 | Fetters | 16/263 |
| 4,542,558 | 9/1985 | Brockhaus | 16/263 |
| 4,800,623 | 1/1989 | Brockhaus | 16/262 |
| 4,854,009 | 8/1989 | Brockhaus | 16/263 |
| 4,864,689 | 9/1989 | Brockhaus | 16/262 |
| 5,033,163 | 7/1991 | Kaibuki et al. | 16/386 |
| 5,761,769 | 6/1998 | Bruckner et al. | 16/386 |

*Primary Examiner*—Chuck Y. Mah
*Attorney, Agent, or Firm*—Anderson, Kill & Olick, P.C.

[57] ABSTRACT

A detachable door hinge for a motor vehicle door including a hinge pin for connecting two hinge flaps for a pivotal movement relative to each other and supported in a gudgeon of one of the two hinge flaps by maintenance-free bearing sleeve for a free rotation and extending into a gudgeon of another of the two hinge flaps, the hinge pin having a radially extending shoulder engageable between adjacent surfaces of the gudgeons of the two hinge flaps, a cone adjoining the radially extending collar and which tapers toward a free end of the hinge pin and is received in a corresponding conical enlargement of a gudgeon bore of the another hinge flap, and an attachment extending into the gudgeon bore of the another hinge flap and having an outer thread and a diameter which is smaller than a diameter of the gudgeon bore of the another hinge flap and a nut for preventing an automatic lifting off of the another hinge flap, and having a neck portion extendable into the gudgeon bore of the another hinge flap into a space between an inner wall of the gudgeon bore and the hinge pin attachment and having an inner thread engageable with the outer thread of the hingepin attachment.

11 Claims, 3 Drawing Sheets

DETACHABLE DOOR HINGE FOR A MOTOR VEHICLE DOOR

BACKGROUND OF THE INVENTION

1. Field of the Invention

The present invention relates to a detachable door hinge for a motor vehicle door and including a first hinge flap connectable with one part of a door assembly, one of a door and a door pillar; a second hinge flap connectable with another part of the door assembly, another of the door and door pillar; a hinge pin for connecting the first and second hinge flaps for a pivotal movement relative to each other, with the hinge pin being supported in a gudgeon of one of the first and second hinge flaps by maintenance-free bearing means for rotation relative to the one of the first and second hinge flap and being connected with a gudgeon of another of the first and second hinge flaps, which is detachably connectable with a respective part of the door assembly, for joint rotation with the another of the first and second hinge flaps, and with the hinge pin having a radially extending shoulder engageable between adjacent surfaces of the gudgeons of the first and second hinge flaps, a cone adjoining the radially extending collar and which tapers toward a free end of the hinge pin and is received in a corresponding conical enlargement of a gudgeon bore of the another of the first and second hinge flaps, and an attachment extending into the gudgeon bore of the another of the first and second hinge flaps and having an outer thread, and a nut for preventing an automatic lifting off of the another of the first and second hinge flaps, with the nut having a conical collar engageable in a corresponding conical enlargement formed in the gudgeon bore of the another of the first and second flaps opposite the conical enlargement for receiving the hinge pin cone.

2. Field of the Invention

Detachable door hinges of the type described above are used in modern motor vehicles in order to detach a vehicle door, which has been attached to the vehicle body and adjusted thereto, after the vehicle body has been coated, to equip it with the accessories and to subsequently attach it to the vehicle body during the final assembly without any adjustment and alignment. With the detachable hinges of the type described above, a uniform cylindrical portion of the hinge pin, which extends in the gudgeon bore of the detachable hinge flap, should have a diameter smaller than the inner diameter of the gudgeon bore in order to enable or to facilitate a mechanized re-attachment of a motor vehicle door to the motor vehicle body.

Therefrom, it follows that centering of the hinge pin in the gudgeon bore, namely, of the hinge pin cone which, on one hand, adjoins the hinge pin shoulder and, on the other hand, adjoins the nut, with respect to a conical enlargement of the gudgeon bore of the detachable hinge flap for receiving the cone is necessary. A centering position of the hinge pin cone and the conical enlargement of the gudgeon bore is achieved upon screwing of the nut onto the threaded hinge portion. The retaining of the centering position of the hinge pin with respect to the gudgeon of the detachable hinge flap is based on the achieved, as a result of screwing of the nut onto the hinge pin, surface pressure between the hinge pin cone, on one side, and on the other side, the nut cone and the conical enlargement of the hinge bore of the detachable hinge flap.

In order to provide for a such implementation of the support of the detachable hinge flap on the hinge pin, with the gudgeon bore tilting relative to the hinge pin as a result of ever increasing weight of modern vehicle doors resulting, e.g., from mounting therein motorized drives, e.g., a window opener, the threaded connection of a nut with an appropriate attachment of the hinge pin is arranged above the gudgeon of the detachable hinge pin.

With such an arrangement, the screwing of the nut onto the hinge pin can actually be prohibited for heavy vehicle doors. This is because the gudgeon of the detachable hinge flap gradually occupies a position at which it extends at a certain angle toward the hinge pin axis, or because the door gradually sinks. It is also necessary that the threaded attachment of the hinge pin, onto which a nut is being screwed, is sufficiently long which requires that an unfavorable and relatively long detachment path for detaching the hinge be provided.

Accordingly, an object of the present invention is a detachable door hinge for a motor vehicle door of the type described above in which the above-described drawbacks of mounting of the detachable hinge flap on the hinge pin is reliably prevented, without increase in the manufacturing and/or assembly costs.

Another object of the present invention is to provide a detachable door hinge of the type described above in which a stable radial support of the detachable hinge flap on the hinge pin is reliably insured.

A further object of the present invention is a detachable door hinge of the type described above in which the length of the hinge pin is reduced.

SUMMARY OF THE INVENTION

These and other objects of the present invention, which will become apparent hereinafter, are achieved by providing a nut having a neck portion extendable into gudgeon bore of the another of the first and second hinge flaps into a space between an inner wall of the gudgeon bore and the cone attachment of the hinge pin and having an inner thread engageable with the outer thread of the hinge pin attachment for securing the nut on the another of the first and second hinge flaps.

This design of the hinge pin and the associated nut provides a possibility for screwing the nut onto the threaded portion of the hinge pin in the gudgeon bore of the detachable hinge flap. Simultaneously, a reliable radial support between the gudgeon and the hinge pin at both ends of the gudgeon bore of the detachable hinge flap is achieved. Further, locating the region of the threaded connection of the nut with the hinge pin inside the gudgeon bore permits to reduce the detachment path length necessary for detaching the hinge path to that of the gudgeon bore itself. Still further, locating the region of the threaded connection of the nut with the hinge pin inside the bore permits to reduce the length and thereby the weight of the hinge pin, without increasing the manufacturing costs and without reducing the stability of the connection of the detachable hinge flap with the hinge pin.

Further, the outer diameter of the nut neck portion is so selected that it corresponds to the inner diameter of the gudgeon bore of the detachable hinge flap.

According to one preferred embodiment of the present invention, the axial length of the nut neck portion is so selected that it corresponds to at least one-fifth of a length of the gudgeon bore of the another of the first and second hinge flaps, and the hinge pin has a base adjoining an end surface of the cone opposite to the shoulder and having a diameter corresponding to an inner diameter of the gudgeon bore of the another of the first and second hinge flaps, and a length corresponding likewise to at least one-fifth of an axial length of the gudgeon bore. This insures that the detachable hinge flap is supported in the vicinity of its opposite outer radial surfaces against the hinge pin and is centered thereon, which completely prevents an unfavorable sitting of a motor vehicle door.

The location of the region of the threaded connection of the nut with the hinge pin inside the gudgeon bore leads to that the threaded portion of the hinge pin is only partially engaged with the threaded bore of the nut. The advantage of this consists in that the nut threaded bore can be covered from outside, with the cover advantageously not being detachable from the nut body. Thereby, an accumulation of dirt or lacque or other similar materials in the upper region of the nut bore and, thereby, any drawbacks resulting from the dirt and/or lacque accumulation, are prevented.

With regard to tool-engageable elements of the nut, a plurality of possible nut designs are possible.

In accordance with one embodiment of the nut, the nut with a polyhedral tool-engageable section is formed either as a one-piece domed cap nut or as a combination cap nut with an attachable dome-shaped cap member.

In accordance with another embodiment of the nut, the nut with a polyhedral tool-engageable section has its threaded bore covered by a sealing disc member, with the disc member being preferably arranged in a recess provided in an end of the nut remote from the nut neck portion with the radial dimension of the recess exceeding that of the threaded bore of the nut. The sealing disc member can be retained in the recess with a beading provided at the edge of the recess. In a modified embodiment of the nut, the sealing disc member has a centrally arranged centering indentation.

In a further modified embodiment of the nut, the nut may be provided with a centrally arranged axial coined section defining the centering element of the nut, with the coined section simultaneously connecting the sealing disc member with the nut body.

When the nut is formed as a one-piece part and has a bore cover, the nut body can have an axial region extending above the threaded bore and forming the nut cap. The nut body of the nut has an axial coined section having a cross-section which is adapted for being engaged by a tool. The coined section is so formed that between it and the threaded bore, a covering wall which extends substantially transverse to the axis of the threaded bore remain. In this embodiment, the coined section can be formed as a torus, serving as a tool-engageable element of the nut. In another embodiment, the nut in addition to the inner coined section can have an outer coined section also formed as a torus.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 1:
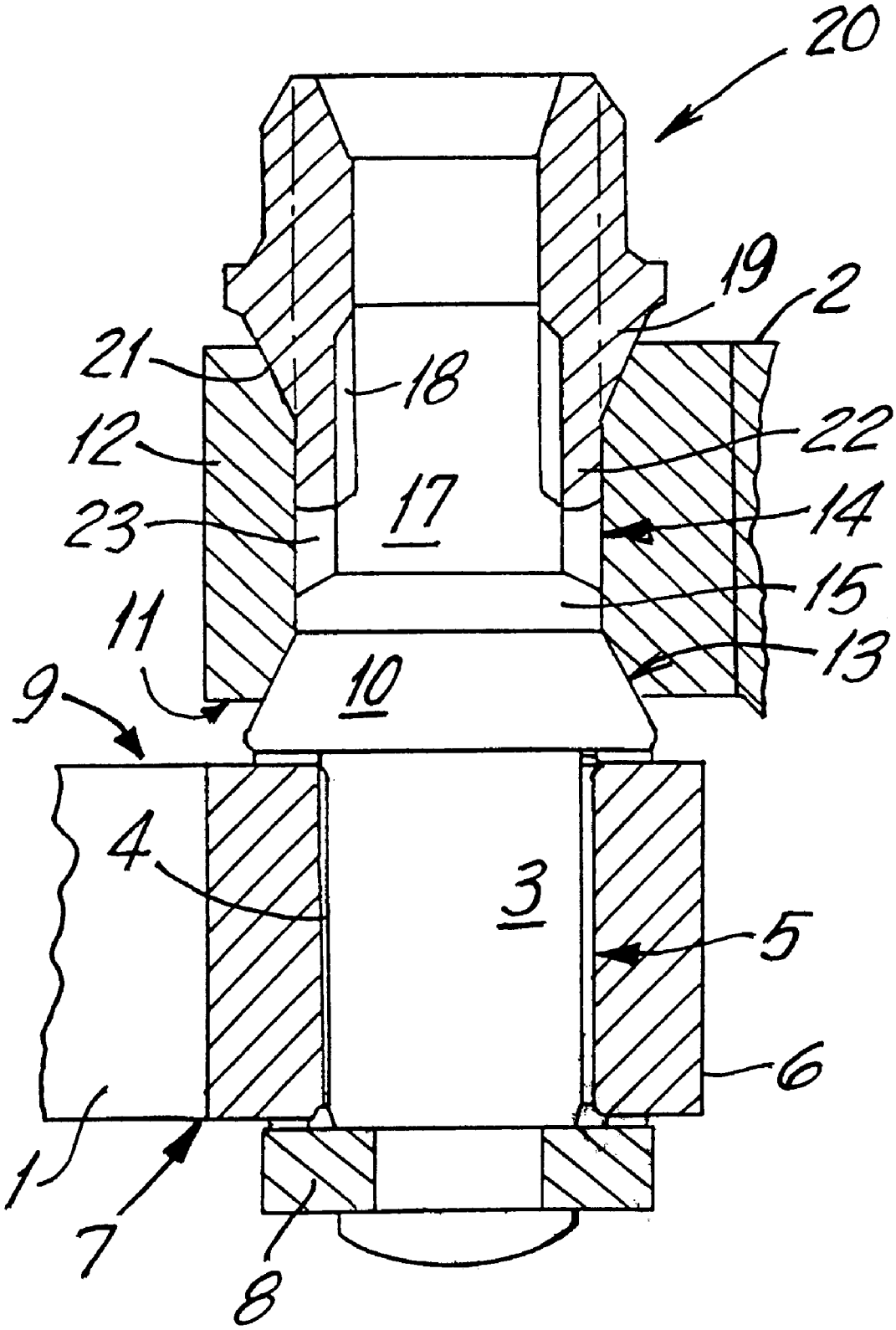
FIG. 1 is a longitudinal cross-sectional view of a detachable door hinge for a motor vehicle door according to the present invention.

In a detachable hinge for a motor vehicle door one hinge flap 1 of which is attached to one part of a door assembly, not shown in the drawings, and another hinge part 2 of which is attached to another part of the door assembly, a hinge pin 3 is supported in a hinge gudgeon bore 5 of a gudgeon 6 of the first hinge flap 1 for a fee rotation therein. The hinge pin 3 is supported in the gudgeon bore 5 by a bearing sleeve 4 made of a maintenance-free material. In the hinge gudgeon 6, the hingepin 3 is secured against displacement in an axial direction by a support plate 8 abutting an outer surface of the hinge gudgeon 6, on one hand, and by a shoulder 16 which abuts an opposite surface of the hinge gudgeon 6 and extends radially beyond it, on the other hand.

In its region projecting beyond the first hinge flap 1, the hinge pin 3 has a cone 10 which forms an extension of the shoulder 16 and is received, in an attached position of the hinge, in a conical enlargement 13 of a hinge gudgeon bore 14 of a hinge gudgeon 12 of the second hinge flap 2, which enlargement 13 is provided at a surface 11 of the second hinge flap 2 adjacent to the first hinge flap 1. The hinge pin 3 has, at a bottom of the cone 10 a cylindrical base 15 the diameter of which is complimentary to a diameter of the cylindrical gudgeon bore 14. A cylindrical attachment 17, a diameter of which is smaller than the diameter of the gudgeon bore 14 adjoins the base 15 of the hinge pin 3. The attachment 17 has an outer thread 18 cooperating with an inner thread of a nut 20 which is provided with a conical collar 19. The conical collar 19 engages in a complementary conical enlargement 21 of the gudgeon bore 14. The nut 20 has neck 22 which adjoins the conical collar 19 and which has an inner thread defining, at least partially, the inner thread nut 20. An annular space 23 is provided beneath the neck 22. The annular space 23 is formed between an inner circumference of the hinge gudgeon 12 and the cylindrical attachment 14. In the embodiment shown in FIG. 1, the insertion depth of the base 15 of the hinge pin 3, which adjoins the cone 10 and the insertion depth of the neck 22 of the nut 20 correspond to one fifth of an entire length of the cylindrical gudgeon bore 14. The axial length of the threaded attachment 17 of the hinge pin 3 is limited to an entire height of the hinge gudgeon 12 of the hinge flap. The threaded attachment 17 is received in the threaded bore of the nut 20 as shown in FIG. 1, only partially to accommodate the insertion of the nut 20 into gudgeon bore 12 of the second hinge flap 2.

Figure 3:
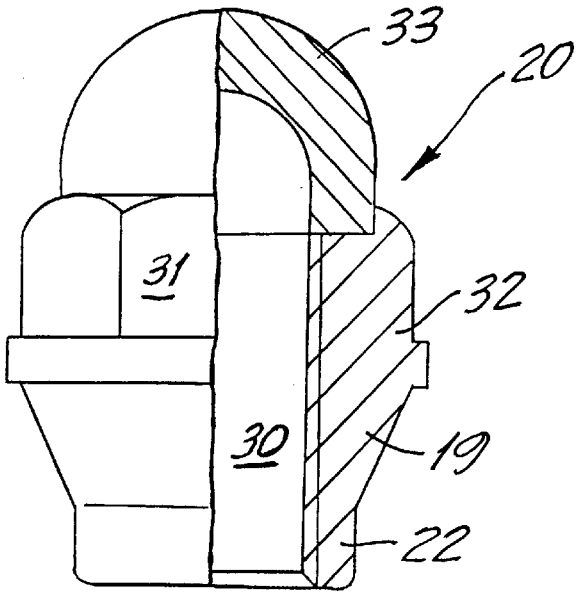
FIG. 3 is a partially cross-sectional side view of a combination domed cap nut according to the present invention.
Figure 2:
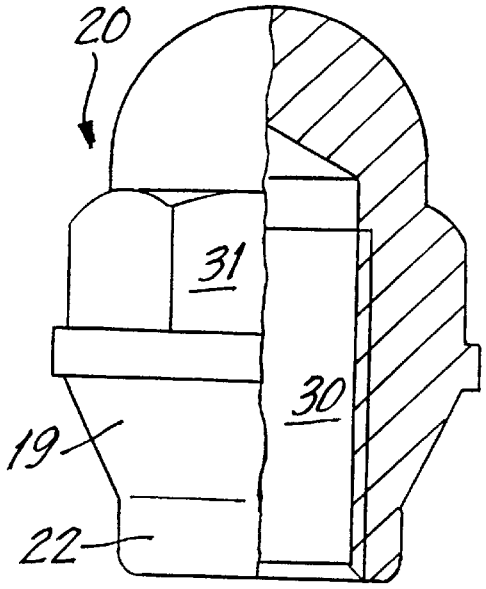
FIG. 2 is a partially cross-sectional side view of a domed cap nut according to the present invention.

FIGS. 2–3 show a first embodiment of the nut 20 having a threaded bore 30, with the nut 20 being formed as shown in FIG. 2 as a one-piece domed cup nut or, as shown in FIG. 3, as a combination domed cut nut formed of a nut body 32 with a tool-engagement multi-edge section 31*a* and dome-shaped cap member 33.

Figure 4:
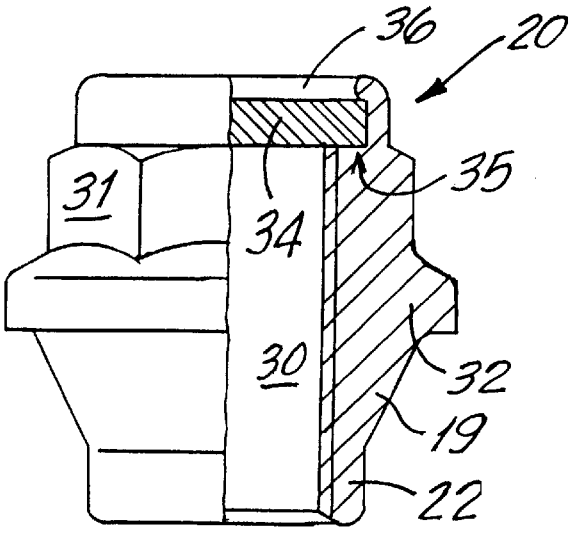
FIG. 4 is a partially cross-sectional side view of a first embodiment of a nut according to the present invention with a sealing disc member.
Figure 5:
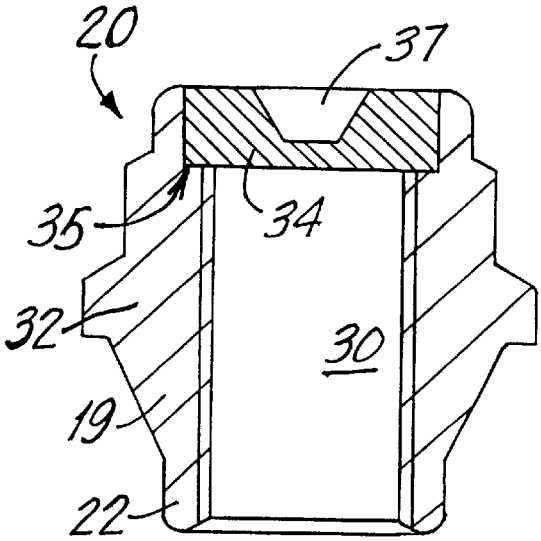
FIG. 5 a partially cross-sectional side view of a second embodiment of a nut with a sealing disc member.
Figure 6:
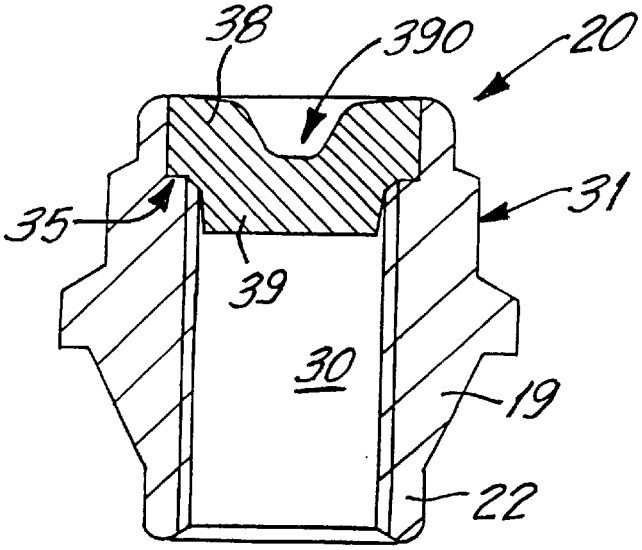
FIG. 6 a partially cross-sectional side view of a third embodiment of a nut according to the present invention with a sealing discmember.

FIGS. 4–6 show different embodiments of the nut 20 provided with a sealing disc member which closes the threaded bore 30 of the nut 20 at the free end of the nut 20.

In the embodiment shown in FIG. 4 a plate-shaped sealing disc member 34 is received in a recess 35 of a nut body 32 provided with a polyhedral tool-engageable section 31. The disc member 34 closes the threaded bore 30 of the nut 20. The sealing disc member 34 is retained in the recess 35 with a beading 36. In the embodiment shown in FIG. 5, the likewise plate-shaped disc member 34 is received in a recess 35 of a nut body 32 likewise provided with a polyhedral receiving section 31. As in the embodiment of FIG. 4, the sealing disc member 39 closes the threaded bore 30 of the nut 20. The sealing disc member 34 shown in FIG. 5 has a center indentation 37.

In the embodiment shown in FIG. 6 a sealing disc member 38 is likewise received in the recess 35 of the nut body 32 provided with a polyhedral tool-engageable section 31. The sealing disc-shape member shown in FIG. 6, is formed as a shaped member with a central axial projection 39 extending into the threaded bore 30 of the nut 20.

Figure 7:
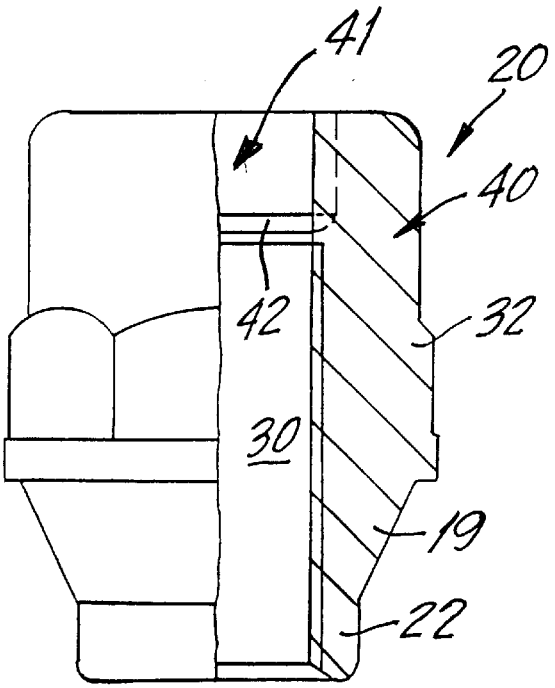
FIG. 7 a partially cross-sectional side view of a first embodiment of a nut with an internal tool-engageable element.
Figure 8:
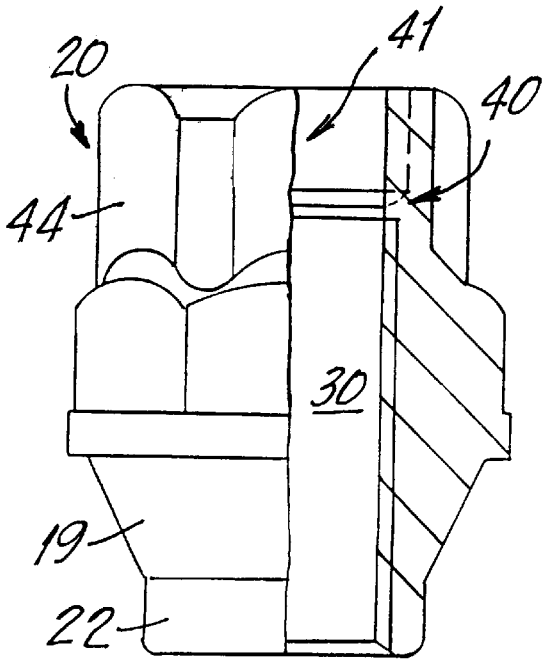
FIG. 8 a partially cross-sectional side view of a second embodiment of a nut with an internal tool-engageable element.

In FIGS. 7 and 8, two further embodiments of the nut 20 are shown. In both these embodiments the nut 20 is formed as a one-piece part. In the embodiment of FIG. 7, the nut body 32 of the nut 20 has an axial region 40 extending above the threaded bore 30 and forming the nut cap. The nut body 32 of the nut 20, which is shown in FIG. 7, has an axial coined section 41 having a cross-section which is adapted for being engaged by a tool. The coined section 41 is so formed that between it and the threaded bore 30, a covering wall 42, which extends substantially transverse to the axis of the threaded bore 30, remain. The coined section 41, which is formed as a torus, serves as a tool-engageable element of the nut 20. The nut 20 shown in FIG. 8 differs from the nut 20 shown in FIG. 7 in that the nut 20 in addition to the inner coined section 41 has an outer coined section 44 forming a second tool-receiving element of the nut 20.

Though the present invention was shown and described with references to the preferred embodiments, various modifications thereof will be apparent to these skilled in the art and, therefore, it is not intended that the invention be limited to the disclosed embodiments or details thereof, and departure can be made thereform within the spirit and scope of the appended claims.

What is claimed is:

1. A detachable door hinge for a motor vehicle door, comprising:

a first hinge flap connectable with one part of a door assembly, one of a door and a door pillar;

a second hinge flap connectable with another part of the door assembly, another of the door and door pillar;

a hinge pin for connecting the first and second hinge flaps, for a pivotal movement relative to each other, the hinge pin being supported in a gudgeon of one of the first and second hinge flaps by maintenance-free bearing means for rotation relative to the one of the first and second hinge flap and being connected with a gudgeon of another of the first and second hinge flaps, which is detachably connectable with a respective part of the door assembly, for joint rotation with the another of the first and second hinge flaps, and the hinge pin having a radially extending shoulder engageable between adjacent surfaces of the gudgeons of the first and second hinge flaps, a cone adjoining the radially extending shoulder and which tapers toward a free end of the hinge pin and is received in a corresponding conical enlargement of a gudgeon bore of the another of the first and second hinge flaps, and an attachment extending into the gudgeon bore of the another of the first and second hinge flap and having an outer thread and a diameter which is smaller than a diameter of the gudgeon bore of the another of the first and second hinge flaps; and a nut for preventing an automatic lifting off of the another of the first and second hinge flaps, the nut having a conical collar engageable in a corresponding conical enlargement formed in the gudgeon bore of the another of the first and second flaps opposite the conical enlargement for receiving the hinge pin cone, and a neck portion extendable into the gudgeon bore of the another of the first and second hinge flaps into a space between an inner wall of the gudgeon bore and the cone attachment and having an inner thread engageable with the outer thread of the cone attachment for securing the nut on the another of the first and second hinge flaps.

2. A door hinge as set forth in claim 1, wherein the neck portion has a diameter corresponding to a diameter of the gudgeon bore of the another of the first and second hinge flaps.

3. A door hinge as set forth in claim 1, wherein an axial length of the nut neck portion corresponds to at least one fifth of a length of the gudgeon bore of the another of the first and second hinge flap.

4. A door hinge as set forth in claim 1, wherein the hinge pin has base adjoining an end surface of the cone opposite to the shoulder and having a diameter corresponding to an inner diameter of the gudgeon bore of the another of the first and second hinge flaps and a length corresponding to at least one-fifth of an axial length of the gudgeon bore.

5. A door hinge as set forth in claim 1, wherein the nut has a polyhedral tool-engageable section and is formed as a domed cap nut.

6. A door hinge as set forth in claim 1, wherein the nut has a polyhedral tool-engageable section and is covered with a dome-shaped cap member, whereby a domed cap nut is formed.

7. A door hinge as set forth in claim 1, further comprising a sealing disc member covering the free end of the hinge pin and receivable in a recess provided in an end of the nut remote from the neck portion, the nut having a heading, a radial dimension of which exceeds a radial dimension of the recess for retaining the sealing disc member in the recess.

8. A door hinge as set forth in claim 1, further comprising a sealing disc member covering the free end of the hinge pin and receivable in a recess provide in an end of the nut remote from the neck portion, the sealing disc member having a centrally arranged indentation.

9. A door hinge as set forth in claim 1, further comprising a sealing disc member covering the free end of the hinge pin and receivable in a recess provided in an end of the nut remote from the neck portion, the sealing disc member having a centrally arranged coined section forming a centering attachment.

10. A door hinge as set forth in claim 1, further comprising a sealing disc member covering the free end of the hinge pin and receivable in a recess provided in an end of the nut remote from the neck portion, the sealing disc member having a centrally arranged, coined section, the coined section forming an upper region of the nut and having a separation wall covering the free end of the hinge pin, with the coined section having an inner torus cross-section defining a tool-engageable element of the nut.

11. A door hinge as set forth in claim 10, wherein the coined section has a further tool-engageable portion having a cross-section of an outer torus.

* * * * *